US008874015B2

(12) United States Patent
Akashi et al.

(10) Patent No.: US 8,874,015 B2
(45) Date of Patent: Oct. 28, 2014

(54) IMAGE FORMING APPARATUS

(75) Inventors: Kazukiyo Akashi, Kashiwa (JP); Jun Mochizuki, Abiko (JP); Yasuhito Shirafuji, Kashiwa (JP); Yasushi Takeuchi, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 62 days.

(21) Appl. No.: 13/456,708

(22) Filed: Apr. 26, 2012

(65) Prior Publication Data

US 2012/0282001 A1 Nov. 8, 2012

(30) Foreign Application Priority Data

May 2, 2011 (JP) ..... 2011-102670

(51) Int. Cl.
*G03G 15/16* (2006.01)
*G03G 15/01* (2006.01)

(52) U.S. Cl.
CPC .... *G03G 15/1605* (2013.01); *G03G 2215/1614* (2013.01); *G03G 15/0131* (2013.01); *G03G 15/1615* (2013.01); *G03G 15/0189* (2013.01); *G03G 2215/0129* (2013.01)
USPC ..... 399/302; 399/66; 399/308; 399/313

(58) Field of Classification Search
CPC ..... G03G 15/0131; G03G 15/0189; G03G 15/1605; G03G 15/1625; G03G 15/1615; G03G 15/165; G03G 15/1665; G03G 15/167; G03G 2215/00704; G03G 2215/0129; G03G 2215/16; G03G 2215/1614; G03G 2215/1623; G03G 2215/1695; G03G 15/1645
USPC ..... 399/297–299, 302, 308, 313, 66
See application file for complete search history.

(56) References Cited

U.S. PATENT DOCUMENTS

| | | | | |
|---|---|---|---|---|
| 7,039,349 | B2 * | 5/2006 | Sohmiya et al. | 399/309 |
| 8,059,978 | B2 * | 11/2011 | Mizushima et al. | 399/45 |
| 8,385,793 | B2 * | 2/2013 | Furuya et al. | 399/302 |
| 2006/0171749 | A1 * | 8/2006 | Tomita et al. | 399/329 |
| 2006/0263119 | A1 * | 11/2006 | Kim et al. | 399/299 |
| 2009/0175641 | A1 * | 7/2009 | Mizushima et al. | 399/51 |
| 2009/0232536 | A1 * | 9/2009 | Nishimura et al. | 399/71 |

FOREIGN PATENT DOCUMENTS

| | | | |
|---|---|---|---|
| JP | 2001-166611 | A | 6/2001 |
| JP | 2003-270974 | A | 9/2003 |
| JP | 2004-029054 | A | 1/2004 |
| JP | 2010-128235 | A | 6/2010 |
| JP | 2010-243553 | A | 10/2010 |

OTHER PUBLICATIONS

Machine Translation of Japanese Patent Document 2003-270974. Sep. 25, 2003.*

* cited by examiner

*Primary Examiner* — David Gray
*Assistant Examiner* — Carla Therrien
(74) *Attorney, Agent, or Firm* — Canon USA Inc IP Division

(57) ABSTRACT

A first transfer inner roller and a first transfer outer roller are arranged such that the leading edge of a recording material is pressed against an intermediate transfer member on the downstream side of an upstream side transfer portion to change a traveling direction of the recording material.

3 Claims, 7 Drawing Sheets

IMAGE FORMING APPARATUS

BACKGROUND OF THE INVENTION

1. Field of the Invention

The present invention relates to an image forming apparatus such as a copying machine or a printer employing the electrophotographic process or the electrostatic recording process.

2. Description of the Related Art

An image forming apparatus is adopted to be applicable to various recording materials. The image forming apparatus has a transfer unit configured to transfer a toner image formed on an image bearing member such as a photosensitive drum onto an intermediate transfer member and then to transfer the toner image formed on the intermediate transfer member onto a recording material.

Japanese Patent Application Laid-Open No. 2003-270974 discusses a technique is directed to suppressing the application voltage for transferring the toner image onto the recording material and to achieving an improvement in terms of image quality. The technique discussed in Japanese Patent Application Laid-Open No. 2003-270974 adopts a configuration in which a transfer portion is formed by two transfer inner rollers in contact with the inner surface of the intermediate transfer member and by two transfer outer rollers held in contact with the outer surface of the intermediate transfer member to pressurize the transfer inner rollers via the intermediate transfer member.

However, when the leading edge of the recording material having left the transfer portion formed by the first transfer inner roller and the first transfer outer roller on the upstream side is directed away from the intermediate transfer belt, there is a fear of a reduction in adhesiveness between the leading edge and the intermediate transfer belt after the leading edge has passed the transfer portion. As a result, there is a fear of the property of conveyance for the recording material toward the transfer portion formed by the second transfer outer roller and the second transfer inner roller on the downstream side becoming unstable, or a fear of the transfer property being deteriorated.

SUMMARY OF THE INVENTION

The present invention is directed to a configuration of the type in which two transfer portions are formed and in which a toner image is transferred to a recording material from an intermediate transfer member, wherein it is possible to suppress the reduction in the adhesiveness between the leading edge of the recording material and the intermediate transfer member after the leading edge has passed the transfer portion on the upstream side.

According to an aspect of the present invention, an image forming apparatus includes: an image bearing member configured to bear a toner image; a movable intermediate transfer member configured to bear the toner image transferred thereto from the image bearing member; and a transfer unit configured to transfer the toner image from the intermediate transfer member to a recording material, the transfer unit including: a first transfer inner roller for supporting the intermediate transfer member from an inner peripheral surface and transferring the toner image to the recording material from the intermediate transfer member; a second transfer inner roller arranged on the downstream side of the first transfer inner roller in the moving direction of the intermediate transfer member and supporting the intermediate transfer member from the inner peripheral surface and transferring the toner image to the recording material from the intermediate transfer member; a first transfer outer roller arranged so as to be deviated downstream from the first transfer inner roller in the moving direction of the intermediate transfer member and forming a first transfer portion configured to pinch the intermediate transfer member between itself and the first transfer inner roller and to transfer the toner image to the recording material from the intermediate transfer member; and a second transfer outer roller forming a second transfer portion configured to hold the intermediate transfer member between itself and the second transfer inner roller and to transfer the toner image to the recording material from the intermediate transfer member, wherein the first transfer inner roller and the first transfer outer roller are arranged such that the first transfer inner roller has a portion pushing the intermediate transfer member toward the side where the first transfer outer roller is arranged beyond an extension of the intermediate transfer belt between the first transfer portion and the second transfer portion.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
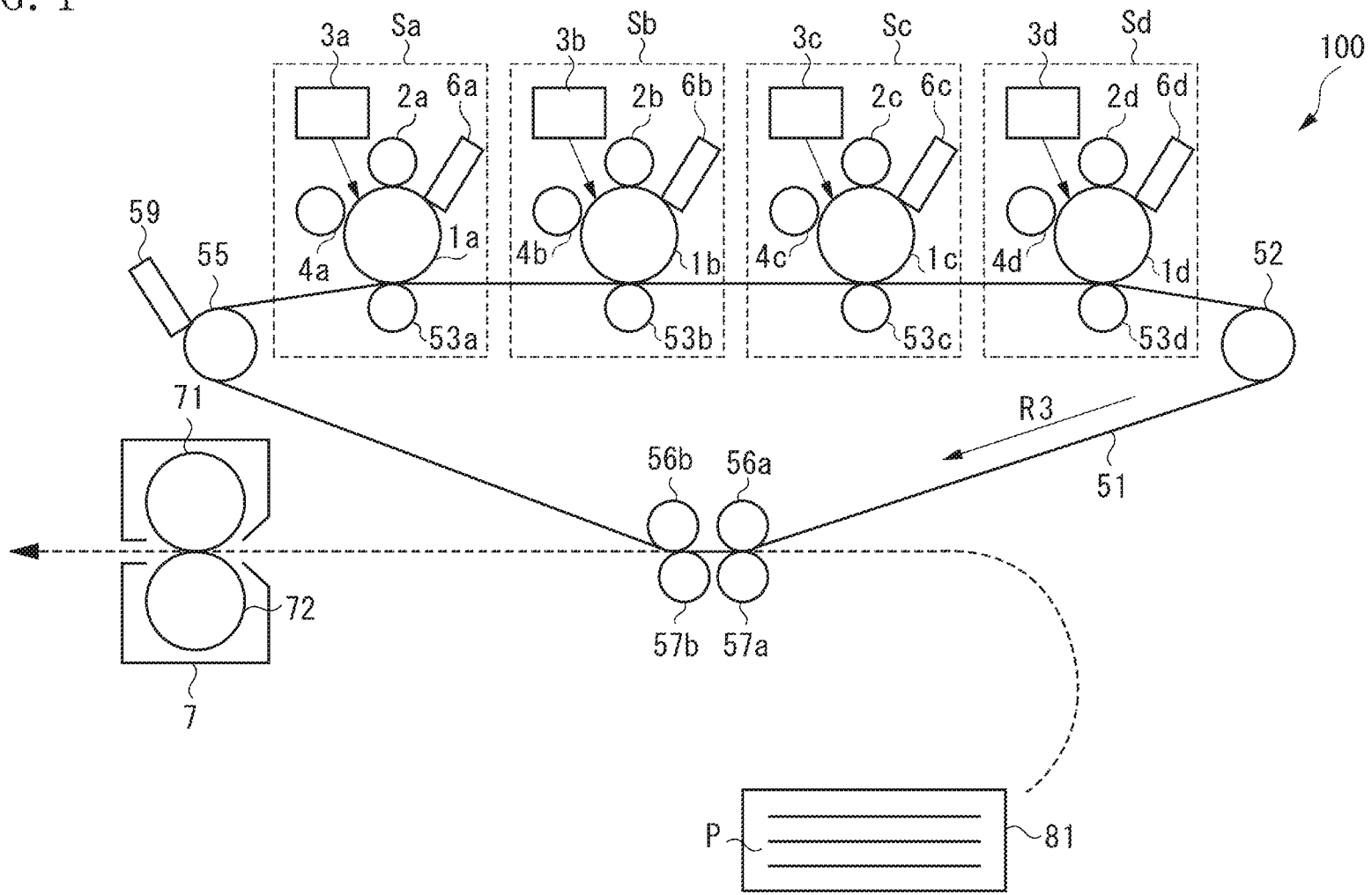
FIG. 1 is a schematic sectional view illustrating the system configuration of an image forming apparatus.

First, the general configuration and operation of an image forming apparatus according the first exemplary embodiment of the present invention will be illustrated. FIG. 1 is a schematic sectional view illustrating the configuration of an image forming apparatus 100 according to the present exemplary embodiment.

Sa, Sb, Sc, and Sd are process units serving as image forming units for forming toner images. The image forming units Sa, Sb, Sc, and Sd respectively form toner images in the colors of yellow, magenta, cyan, and black. The image forming units Sa, Sb, Sc, and Sd are of the same construction except for the colors of the toners used, so the image forming unit Sa will be illustrated as a representative.

The image forming unit Sa is equipped with a photosensitive drum 1*a* serving as an image bearing member, a charging roller 2*a* serving as a charging unit for charging a surface of the photosensitive drum 1*a*, and a laser scanner 3*a* serving as an exposure unit for exposing the surface of the charged photosensitive drum. Further, the image forming unit Sa is equipped with a developing device 4*a* as a developing unit for developing a toner image, and a primary transfer roller 53*a* serving as a primary transfer unit for transferring the toner image from the photosensitive drum 1*a* to an intermediate transfer belt 51. The photosensitive drum 1*a* is rotated, and the surface of the photosensitive drum 1*a* is charged by the charging roller 2*a*. The surface of the charged photosensitive drum 1*a* is exposed by the laser scanner 3*a*, and an electrostatic latent image is formed on the photosensitive drum 1*a*. The electrostatic latent image is formed according to image information through turning ON/OFF of the output of the laser scanner 3*a* based on the image information.

The developing device 4*a* contains yellow toner. A predetermined voltage is applied to the developing device 4*a*, and the electrostatic latent image is developed when passing the developing device 4*a*, forming a toner image on the surface of the photosensitive drum 1*a*. As the development system, there is adopted a reversal development system in which toner is caused to adhere to the exposed portion of the electrostatic latent image to thereby effect development. The primary transfer roller 53*a* is arranged so as to pressurize the photosensitive drum 1*a* via the intermediate transfer belt 51, and forms a primary transfer portion for transferring the toner image to the intermediate transfer belt 51. A primary transfer voltage is applied to the primary transfer roller 53*a* by a primary transfer power source 54*a*, whereby the toner image on the photosensitive drum 1*a* is transferred to the intermediate transfer belt 51. The toner remaining on the photosensitive drum 1*a* is cleaned by a drum cleaner 6*a*.

When forming a full-color image, toner images of the each color are transferred successively to the intermediate transfer belt 51 by the respective transfer units, and are superimposed one upon the other. The intermediate transfer belt 51 functions as an intermediate transfer member configured to bear and convey the toner images transferred from the photosensitive drums 1*a*, 1*b*, 1*c*, and 1*d*. The intermediate transfer belt 51 is arranged such that an outer peripheral surface thereof is in contact with the surfaces of the photosensitive drums 1*a*, 1*b*, 1*c*, and 1*d*; it is a movable belt member stretched by a plurality of support members 52, 55, 56*a*, and 56*b*. The intermediate transfer belt 51 used is one of a thickness of 80 μm and formed of a polyimide (PI) resin exhibiting a surface resistance of $10^{12}$ Ω/□ (the probe used is one according to JIS-K6911; applied voltage: 100V; application time: 60 sec; application condition: 23° C/50%RH). Of course, this should not be construed restrictively; it is also possible to adopt, as the material of the intermediate transfer belt 51, a dielectric resin such as polycarbonate (PC), polyethylene terephthalate (PET), or polyvinylidene fluoride (PVDF). The support member 52 functions as driving roller configured to drive the movement of the intermediate transfer belt 51. The intermediate transfer belt 51 receives a drive force by the intermediate transfer belt driving roller 52, and moves around in the direction of the arrow R3 in FIG. 1.

The rollers 56*a* and 56*b* function as secondary transfer inner rollers for transferring the toner image to the recording material. The rollers 57*a* and 57*b* are arranged so as to pressurize the secondary transfer inner rollers 56*a* and 56*b* from the outer peripheral surface side of the intermediate transfer belt 51. As illustrated in detail below, the secondary transfer inner rollers 56*a* and 56*b* and the secondary transfer outer rollers 57*a* and 57*b* function as the secondary transfer members forming a secondary transfer portion for transferring the toner image to the recording material from the intermediate transfer member. The configuration of the secondary transfer unit for transferring the toner image to the recording material will be illustrated in detail below.

The recording material is accommodated in a cassette 81 serving as a recording material accommodation unit. The recording material is taken from the cassette 81 as the recording material accommodation unit, and is conveyed. The timing with which the recording material is conveyed is in synchronization with the timing with which the toner images are conveyed to the portion of the intermediate transfer member stretched between the secondary transfer inner rollers 56*a* and 56*b*.

After the secondary transfer, the recording material is conveyed to a fixing device 7 serving as a fixing unit for fixing the toner image to the recording material. The portion of the toner (secondary transfer residual toner) not transferred to the recording material at the secondary transfer portion and remaining on the intermediate transfer belt 51 is removed and recovered by an intermediate transfer belt cleaner 59.

The fixing device 7 has a fixing roller 71 arranged rotatably, and pressurization roller 72 configured to rotate while pressurizing the fixing roller 71. A heater 73 consisting of a halogen lamp or the like is arranged inside the fixing roller 71. And, by controlling voltage or the like supplied to this heater 73, the temperature of the surface of the fixing roller 71 is adjusted. When the recording material P is conveyed to the fixing device 7, the recording material P is pressurized and heated at a substantially constant pressure and temperature from both the front and back sides thereof when the recording material P passes between the fixing roller 71 and the pressurization roller 72, which rotate at a constant speed. As a result, the unfixed toner image on the surface of the recording material P is melted, and is fixed to the recording material P. In this way, the formation of the image on the surface of the recording material P is completed.

In the present exemplary embodiment, the processing speed (the peripheral speed of the photosensitive drum 1 and of the intermediate transfer belt 51 and the conveyance speed of the recording material P) is set to 300 mm/sec.

The configuration of the secondary transfer unit will be illustrated. In the present exemplary embodiment, the secondary transfer unit, which transfers the toner image from the intermediate transfer belt to the recording material, is equipped with the secondary transfer inner rollers 56*a* and 56*b* and the secondary transfer outer rollers 57*a* and 57*b*. In other words, the secondary transfer inner rollers 56*a* and 56*b* and the secondary transfer outer rollers 57*a* and 57*b* function as the secondary transfer members forming the secondary transfer portion for transferring the toner image from the intermediate transfer belt 51 to the recording material. This will be illustrated with reference to FIG. 2.

The secondary transfer outer roller 57*a* (the first transfer outer roller) on the upstream side pressurizes the secondary transfer inner roller (the first transfer inner roller) 56*a* on the upstream side via the intermediate transfer belt 51, thus forming a first transfer portion N2*a* (first pressurization portion) for transferring the toner image to the recording material. On the other hand, the secondary transfer outer roller (the second transfer outer roller) 57*b* on the downstream side pressurizes the secondary transfer inner roller(the second transfer inner roller) 57*b* on the downstream side via the intermediate transfer belt 51, thus forming a transfer portion N2*b* (second pressurization unit) for transferring the toner image to the recording material.

By thus forming a plurality of transfer portions, it is possible for the width in the conveyance direction of the secondary transfer unit for transferring the toner image to the recording material to be large.

As the secondary transfer inner rollers 56*a* and 56*b*, there are employed elastic rollers consisting of cores 561*a* and 561*b* having an outer diameter of 12 mm and formed of stainless steel (SUS), and ethylene propylene diene monomer (EPDM) layers 562*a* and 562*b* provided around the cores 561*a* and 561*b*. The electrical resistance value of the secondary transfer inner rollers 56*a* and 56*b* are approximately $10^4$ Ω (23° C.; 50% relative humidity (RH)). These values of the secondary transfer inner rollers, of course, are not to be construed restrictively. The electrical resistance value of the secondary transfer inner rollers 56*a* and 56*b* is obtained from an electric current value measured by moving the secondary transfer inner rollers 56*a* and 56*b* held in contact with a metal roller grounded under a load of 500 g in weight at a peripheral speed of 50 mm/sec, and applying a voltage of 50 V to the cores 561*a* and 561*b*.

As the secondary transfer outer rollers 57*a* and 57*b*, there are employed elastic rollers consisting of cores 571*a* and 571*b* having an outer diameter of 12 mm and formed of SUS, and ion conductive urethane sponge layers 572*a* and 572*b* arranged around the cores 571*a* and 571*b* and having a thickness of 6 mm. The electrical resistance value of the secondary transfer outer rollers 572*a* and 572*b* is obtained by the same method as in the case of the secondary transfer inner rollers 56*a* and 56*b*; when the voltage applied is 2000 V, it is approximately $6\times10^7$ Ω (23° C.;50%RH). It is desirable for the resistance value of the secondary transfer outer rollers 57*a* and 57*b* to be not less than approximately $10^7$ Ω. By using a material of a resistance value of not less than approximately $10^7$ Ω to form the secondary transfer outer rollers 57*a* and 57*b*, the resistance value of the secondary transfer outer rollers 57*a* and 57*b* is sufficiently larger as compared with the resistance value of the recording material. As a result, it is possible to suppress an increase in the current flowing through a non-sheet-passing portion where no recording material passes in the width direction at the time of the second transfer.

Secondary transfer voltage power sources 58*a* and 58*b* serve as secondary transfer voltage application units for applying secondary transfer voltage when transferring the toner image to the recording material.

Figure 2:
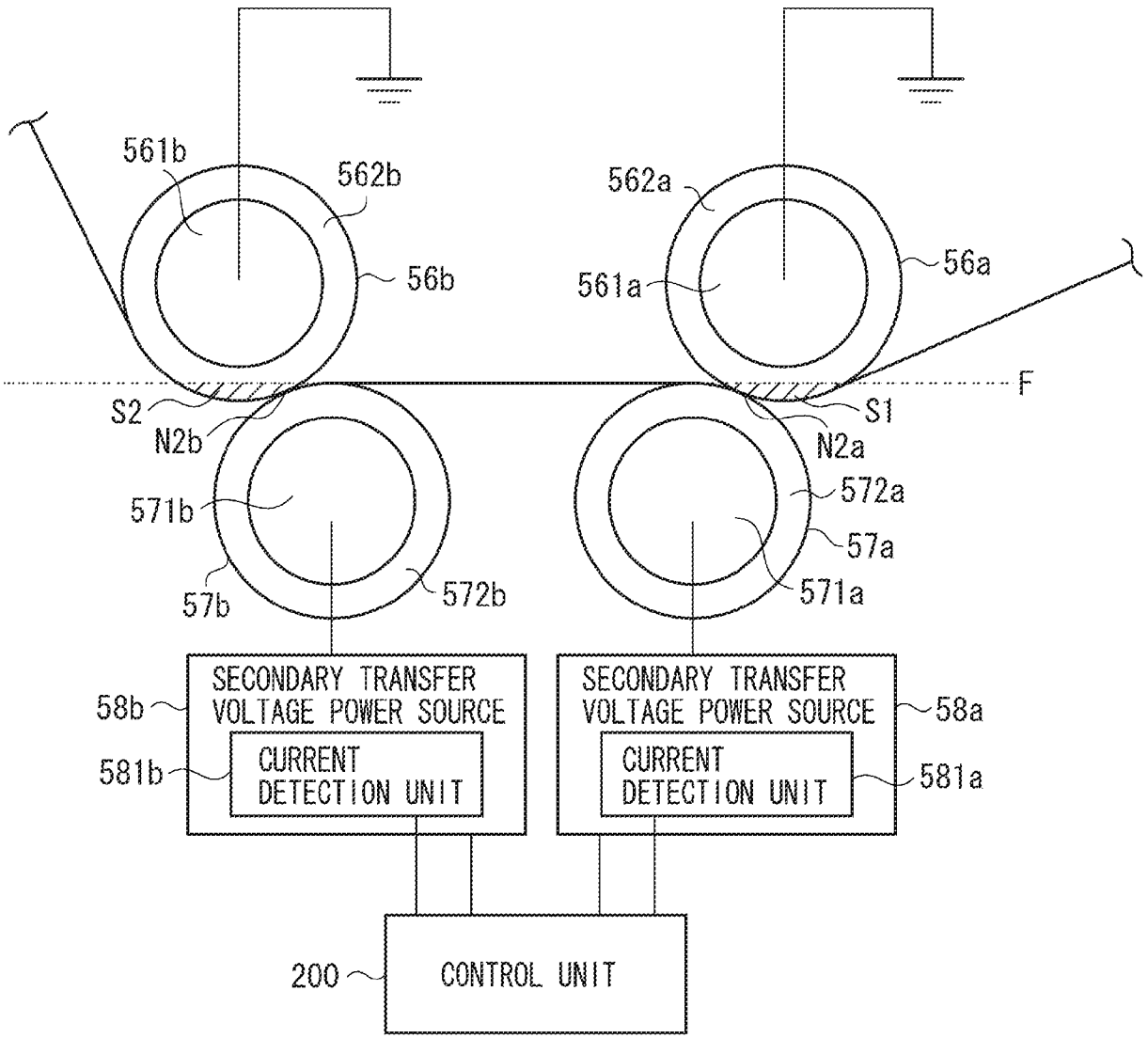
FIG. 2 illustrates the configuration of a secondary transfer unit according to a first exemplary embodiment.

As illustrated in FIG. 2, in the present exemplary embodiment, the secondary transfer voltage power sources 58*a* and 58*b* are respectively connected to the secondary transfer outer rollers 57*a* and 57*b*, and the secondary transfer inner rollers 56*a* and 56*b* are grounded. Thus, when the secondary transfer voltage power source 58*a* applies voltage to the secondary transfer outer roller 57*a* on the upstream side, an electric field is formed between the secondary transfer outer roller 57*a* and the secondary transfer inner roller 56*a* that are on the upstream side. Further, when the secondary transfer voltage power source 58*b* applies voltage to the secondary transfer outer roller 57*b* on the downstream side, an electric field is formed between the secondary transfer outer roller 57*b* and the secondary transfer inner roller 56*b* that are on the downstream side.

When transferring the toner image to the recording material, a voltage of a polarity opposite to the normal polarity (negative polarity) of the toner is applied to each of the secondary transfer outer rollers 57*a* and 57*b* as the secondary transfer voltage for transferring the toner image to the recording material. The transfer electric field formed through the application of the secondary transfer voltage is inclined to move the toner of the normal polarity from the intermediate transfer belt 51 toward the recording material P. The transfer electric field is secured to be formed at two positions: at the first transfer portion N2*a* between the secondary transfer inner roller 56*a* and the secondary transfer outer roller 57*a* on the upstream side and at the second transfer portion N2*b* between the secondary transfer inner roller 56*b* and the secondary transfer outer roller 57*b* on the downstream side. As a result, as the current routes through which the transfer current for transferring the toner image to the recording material, there are formed two current routes: one extending via the first transfer portion N2*a* and one extending via the second transfer portion N2*b*.

The reason for this formation will be illustrated. Depending upon the configuration of the image forming apparatus, the requisite current for transferring the toner image to the recording material may increase. In the conventionally adopted configuration, however, the transfer current for transferring the toner image to the recording material flows through only one route. In such a configuration, in the case where the requisite electric current value for transferring the toner image to the recording material is large, the voltage applied at the secondary transfer portion must be large. As a result, there is a fear of discharge being generated on the upstream side of the secondary transfer portion, disturbing the image. In other words, there is a demand for a configuration in which an increase in application voltage is suppressed even when the requisite electric current value for transferring the toner image is large. In view of this, in the present exemplary embodiment, there are formed two current routes through which the transfer current for transferring the toner image flows, thus dividing the flow of the transfer current. As a result, as compared with the conventional construction in which there is only one route through which the transfer current for transferring the toner image flows, it is possible to suppress an increase in the voltage applied at the secondary transfer unit.

In the present exemplary embodiment, the secondary transfer inner rollers 56*a* and 56*b* are grounded, and the power sources 58*a* and 58*b* for applying bias are respectively connected to the secondary transfer outer rollers 57*a* and 57*b*. The configuration, of course, should not be construed restrictively.

In a modification of the present exemplary embodiment, instead of individually providing the power sources for applying bias to the secondary transfer outer rollers 57*a* and 57*b*, it is also possible a single common power source.

In another modification of the present exemplary embodiment, it is possible to provide three or more secondary transfer outer rollers and to form three or more transfer portions.

The voltage control at the secondary transfer unit will be illustrated. In the present exemplary embodiment, the voltage applied by the secondary transfer voltage power sources 58*a* and 58*b* is controlled by a control unit 200. The control of the control unit 200 is based on information on the basic weight of the recording material as specified by the user, the value of the electric current flowing through the upstream side secondary transfer outer roller 57*a* measured by an electric current measurement unit 581*a*, and the value of the electric current flowing through the downstream side secondary transfer outer roller 57*b* measured by an electric current measurement unit 581*b*. The control unit 200 includes a central processing unit (CPU), read-only memory (ROM), and random-access memory (RAM). The basic weight is a unit indicating the weight per unit area (g/m$^2$); it is generally used as the value indicating the thickness of the recording material.

In the present exemplary embodiment, in order to optimize the secondary transfer voltage for transferring the toner image to the recording material, as the adjustment process for applying an adjustment voltage, an auto transfer voltage control (ATVC) is performed before the secondary transfer process for transferring the toner image to the recording material, i.e., when no sheet is being passed.

The ATVC as the adjustment process is performed by applying a plurality of constant-voltage-controlled adjustment voltages by the secondary transfer voltage power sources, and by respectively measuring the electric currents caused to flow when the adjustment voltages are applied. The reason for doing this is to calculate the relative relationship between voltage and current. Based on the relative relationship between the plurality of applied adjustment voltages and the respectively measured electric currents, a voltage V1 for causing a target current It to flow, which is required for the secondary transfer, is calculated. During the secondary transfer process subsequent to the adjustment process, a voltage (V1+V2) obtained by adding a recording material share voltage V2 shared by the recording material to the voltage V1 is set as the target voltage Vt of the constant-voltage-controlled secondary transfer voltage. As a result, as the secondary transfer voltage, an appropriate voltage value corresponding to the desired transfer current is set. During the secondary transfer, the secondary transfer voltage is applied while constant-voltage-controlled, so that the secondary transfer is conducted in a stable state even when the width of the recording material is changed.

In the present exemplary embodiment, the secondary transfer voltage power sources 58*a* and 58*b* apply secondary transfer voltage to the secondary transfer outer rollers 57*a* and 57*b*, so that it is necessary to optimize the secondary transfer voltage for each of the upstream and downstream secondary transfer outer rollers 57*a* and 57*b*.

The adjustment processes for the upstream and downstream secondary transfer outer rollers 57*a* and 57*b* are conducted in parallel. In other words, the secondary transfer voltage power source 58*a* applies a plurality of adjustment voltages V1 and V2 to the upstream side secondary transfer outer roller 57*a*, and the secondary transfer voltage power source 58*b* applies a plurality of adjustment voltages V1 and V2 to the downstream side secondary transfer outer roller 57*b*. Further, at this time, the current measurement unit 581*a* measures the electric currents I1*a* and I2*a* when the adjustment voltages V1 and V2 are applied to the secondary transfer roller 57*a*. Further, the current measurement unit 581*b* measures the electric currents I1*b* and I2*b* when the adjustment voltages V1 and V2 are applied to the secondary transfer outer roller 57*b*. The measurement by the current measurement unit 581*b* of the electric current flowing through the downstream side secondary transfer outer roller 57*b* is conducted with voltage being applied to the upstream side secondary transfer outer roller 57*a*.

Thus, it is possible to conduct the adjustment of the downstream side secondary transfer outer roller 57*b* in a condition akin to that at the time of image formation. Based on the relative relationship between V1, V2, I1*a*, and I2*a*, there is calculated the voltage V1*a* for passing the upstream side target current Ita required for the secondary transfer at the position of the upstream side secondary transfer outer roller 57*a*. Based on the calculated voltage V1*a*, the target voltage Vta of the secondary transfer voltage applied to the upstream side secondary transfer outer roller 57*a* is set. Similarly, based on the relative relationship between V1, V2, I1*b*, and I2*b*, there is calculated the voltage V1*b* for passing the downstream side target current Itb required for the secondary transfer at the position of the downstream side secondary transfer outer roller 57*b*. Based on the calculated voltage V1*b*, the target voltage Vtb of the secondary transfer voltage applied to the downstream side secondary transfer outer roller 57*b* is set.

The sum total value of the target currents required for the transfer of all the toner images to the recording material is previously set according to the construction of the image forming apparatus, conveyance speed, etc. In the present exemplary embodiment, the proportion of the upstream side target current Vta with respect to the sum total value of the target currents is set to 50%, and the proportion of the downstream side target current Vtb is set to 50%, which means the proportions are set to be the same. Of course, this setting of the proportions should not be construed restrictively.

Figure 3:
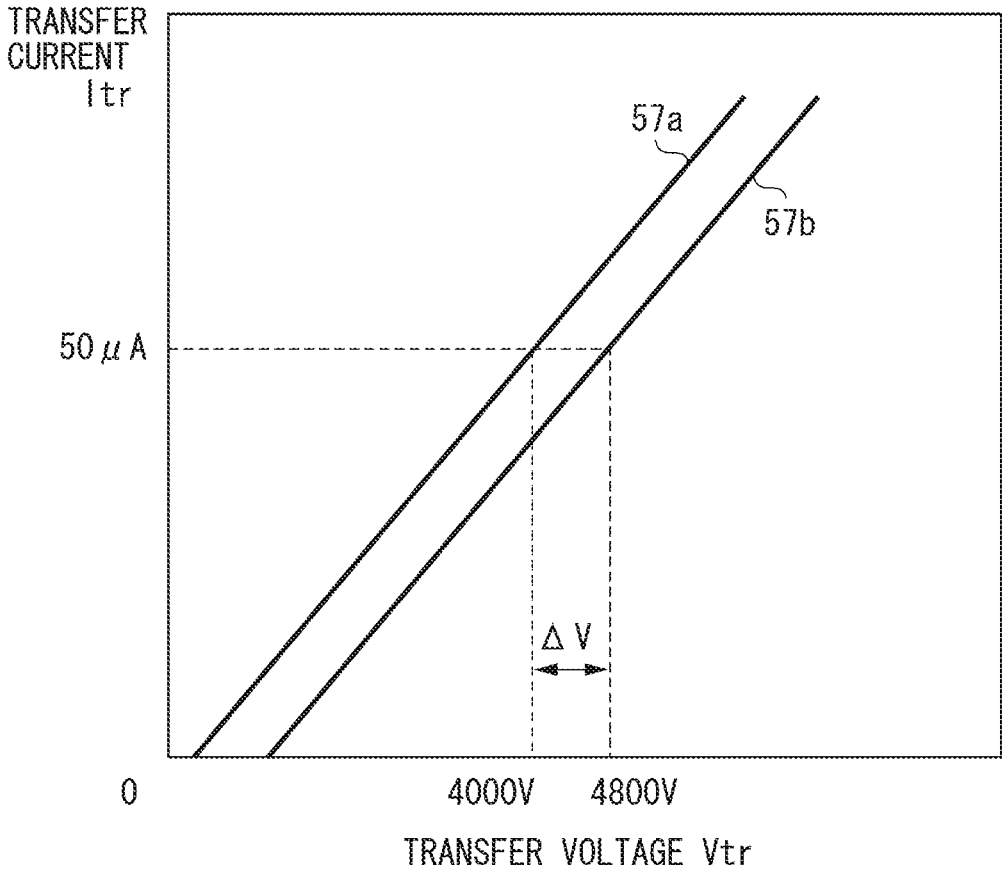
FIG. 3 is a chart illustrating a relationship between transfer current and transfer voltage.

FIG. 3 illustrates the relationship between transfer voltage and transfer current at the secondary transfer portion of the image forming apparatus according to the present exemplary embodiment. At the position of the downstream side secondary transfer outer roller 57*b*, the toner image is rather difficult to transfer due to the toner transferred by the upstream side secondary transfer outer roller 57*a* and the electric charge imparted to the recording material P. Specifically, the requisite voltage for passing the same electric current is higher by ΔV in the case of the downstream side secondary transfer outer roller 57*b* than in the case of the upstream side transfer outer roller 57*a*. In the present exemplary embodiment, the difference in voltage ΔV is approximately 800 V. For example, the requisite application voltage for passing an electric current of 50 μA is 4000 V in the case of the upstream side secondary transfer outer roller 57*a*, whereas it is 4800 V in the case of the downstream side secondary transfer outer roller 57*b*.

In the present exemplary embodiment, in order to set the target voltages Vta and Vtb of the secondary transfer voltages to be applied to the upstream side and downstream side secondary transfer outer rollers 57*a* and 57*b*, adjustment voltages are respectively applied to the upstream side and downstream side secondary transfer outer rollers 57*a* and 57*b*. This, however, should not be construed restrictively. In setting the target voltages Vta and Vtb of the secondary transfer voltages, after applying the adjustment voltage to either one of secondary transfer outer rollers, instead of applying the adjustment voltage to the other secondary transfer outer roller, it is also possible to utilize the relationship of FIG. 3. Specifically, the setting of the target voltage Vta for the upstream side secondary transfer outer roller 57*a* is conducted based on the relative relationship between voltage and current calculated by applying the adjustment voltage with regard to the upstream side secondary transfer outer roller 57*a*. The setting of the target voltage Vtb for the downstream side secondary transfer outer roller 57*b* is conducted based on a relationship attained by shifting by a predetermined value to the high voltage side the relative relationship between voltage and current calculated for the upstream side secondary transfer outer roller 57*a*. As a result, applying the adjustment voltage for the downstream side secondary transfer outer roller 57*b* is not required.

Figure 4A:
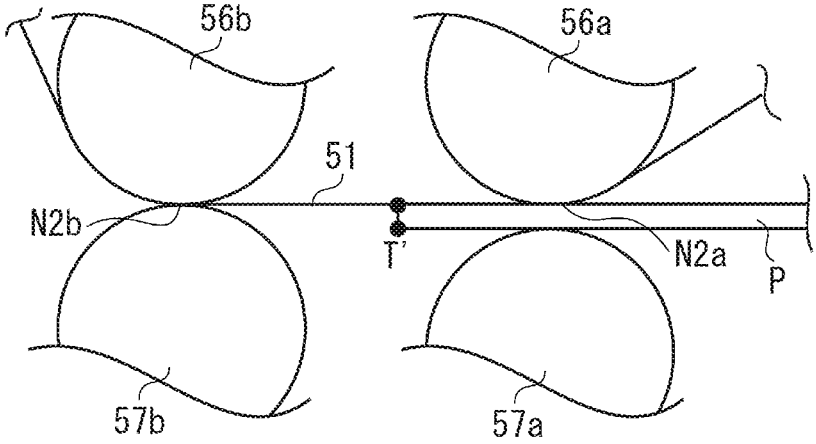
FIGS. 4A and 4B are diagrams illustrating a behavior of a leading edge of a recording material.
Figure 4B:
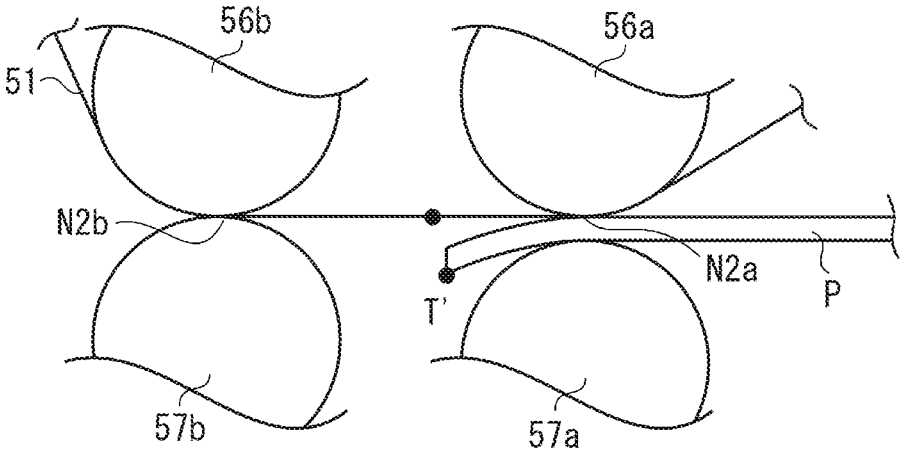
Figure 5:
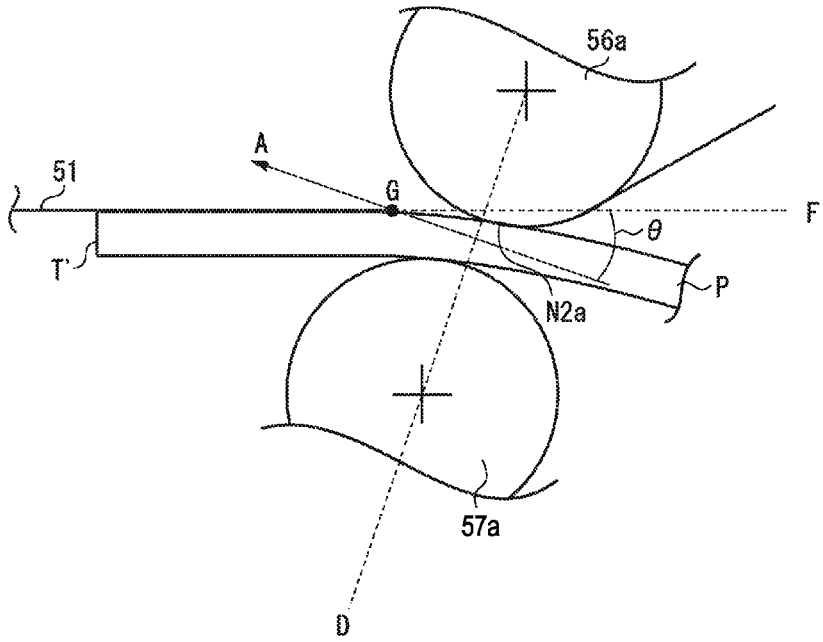
FIG. 5 is a diagram illustrating a portion around an upstream side transfer unit according to the first exemplary embodiment.

Positional relationship between secondary transfer inner roller and secondary transfer outer roller will be described. As illustrated in FIG. 5, in the present exemplary embodiment, when the upstream side transfer portion N2*a* sends out the recording material P, the recording material is caused to enter the outer surface of the linear portion of the intermediate transfer belt between the upstream transfer portion N2*a* and the downstream transfer portion N2*b*. Specifically, of the plurality of transfer portions, in the upstream side transfer portion, the center of the secondary transfer outer roller is deviated from the center of the secondary transfer inner roller to the downstream in the moving direction of the intermediate transfer belt 51. The reason for this arrangement will be illustrated with reference to FIG. 4.

When the basic weight of the recording material P is not less than 64 g/m$^2$, the stiffness of the recording material itself is high, so that the orientation of the recording material is supported by the stiffness of the recording material itself. Thus, after the leading edge T' of the recording material P has passed the upstream side transfer portion N2*a*, the degree of adhesiveness between the recording material and the intermediate transfer belt 51 remains high (FIG. 4A). In other words, the conveyance property of the recording material when conveyed toward the downstream side transfer portion N2*b* is stable. However, when the basic weight of the recording material P is 64 g/m$^2$ or less, the stiffness of the recording material itself is low. Thus, after the leading edge T' of the recording material P has passed the upstream side transfer portion N2*a*, the degree of adhesiveness between the recording material P and the intermediate transfer belt is reduced, with the result that the leading edge T' of the recording material P may be separated from the intermediate transfer belt 51 (FIG. 4B). In other words, the stability of the conveyance property of the recording material when conveyed toward the downstream side transfer portion N2*b* is impaired.

In view of this, as illustrated in FIG. 5, in the present invention, when the upstream side transfer portion N2*a* sends out the recording material, the recording material is caused to enter the outer surface of the linear portion of the intermediate transfer belt 51 between the upstream side transfer portion N2*a* and the downstream side transfer portion N2*b*. In other words, when, at the upstream side transfer portion N2*a*, the recording material is directed to the intermediate transfer belt side, the leading edge T' of the recording material is pressed against the intermediate transfer belt 51. Then, the traveling direction of the recording material is changed at the upstream side transfer portion N2*a*, and the recording material is placed in a bent state. In view of this, at the upstream side transfer portion, the center of the secondary transfer outer roller 57*a* is arranged on the downstream side of the center of the secondary transfer inner roller 56*a* in the moving direction of the intermediate transfer belt 51. Then, the secondary transfer inner roller 56*a* is arranged so as to exhibit a portion S1 situated on the same side as the intermediate transfer outer roller 57*a* with respect to the linear intermediate transfer belt extension (F) between the upstream side transfer portion N2*a* and the downstream side transfer portion N2*b*. In other words, the secondary transfer inner roller and the secondary transfer outer roller are arranged such that the secondary transfer inner roller 56*a* exhibits a portion pushing the intermediate transfer belt to the arrangement side of the secondary transfer outer roller 57*a* with respect to the intermediate transfer belt extension between the upstream side transfer portion N2*a* and the downstream side transfer portion N2*b*. As a result, a reduction in the degree of adhesiveness between the leading edge of the recording material and the intermediate transfer belt 51 after the recording material has left the upstream side transfer portion N2*a*, enabling to stabilize the conveyance of the recording material toward the downstream side transfer portion N2*b*.

In FIG. 5, symbol A indicates the direction in which the upstream side transfer portion N2*a* sends out the recording material. Symbol D indicates the straight line connecting the rotation center of the upstream side secondary transfer inner roller 56*a* and the rotation center of the upstream side secondary transfer outer roller 57*a*. The direction in which the recording material is sent out by the transfer unit is orthogonal to the line connecting the rotation center of the secondary transfer inner roller and the rotation center of the secondary transfer outer roller, so that the line A is a normal (first normal) orthogonal to the line D. Symbol F indicates the extension of the outer surface of the linear portion of the intermediate transfer belt between the upstream side transfer portion N2*a* and the downstream side transfer portion N2*b*.

In the present exemplary embodiment, when the upstream side transfer portion N2*a* sends out the recording material, the leading edge of the recording material enters the outer surface of the linear portion of the intermediate transfer belt between the upstream side transfer portion N2*a* and the downstream side transfer portion N2*b*. In other words, the first normal A crosses the segment between the upstream side transfer portion N2*a* and the downstream side transfer portion N2*b* at an intersection (first intersection) G. Further, on the downstream side of the first intersection G in the rotating direction of the intermediate transfer belt 51, the first normal A is situated on the inner surface side of the intermediate transfer belt 51. The secondary transfer inner rollers 56*a* and 56*b* and the secondary transfer outer roller 57*a* and 57*b* are arranged in the positional relationship as described above.

In FIG. 5, symbol θ indicates the entrance angle at which the leading edge of the recording material enters the outer surface of the linear portion of the intermediate transfer belt 51 between the upstream side transfer portion N2*a* and the downstream side transfer portion N2*b*. In other words, the angle θ (first angle) is an acute angle whose apex is the first intersection G. Further, the angle θ is formed by a half-line of the first normal A on the upstream side of the first intersection G in the rotating direction of the intermediate transfer belt 51 and by a half-line of the extension G of the outer surface of the intermediate transfer belt on the upstream side of the first intersection G in the rotating direction of the intermediate transfer belt 51. In the present exemplary embodiment, the entrance angle θ (first angle) is set to 15°. Of course, this value should not be construed restrictively; however, it is desirable for the angle θ to be set to a range of not less than 10° and not more than 40°. The reason for setting to this range will be illustrated.

When the entrance angle θ is small, it is impossible to sufficiently enhance the adhesiveness between the leading edge of the recording material and the intermediate transfer belt after the recording material has left the upstream side transfer portion N2*a*. Accordingly, it is desirable for the entrance angle θ to be set to a value not less than 10°.

However, when the entrance angle θ increases, the recording material is conveyed such that, at the upstream side transfer portion N2*a*, the intermediate transfer belt 51 is in conformity with the curving of the upstream side transfer outer roller 57*a*. As a result, the leading edge portion of the recording material is wrapped around the upstream side transfer outer roller 57*a*, with the result that there is a fear of defective conveyance. In view of this, to suppress wrapping of the recording material around the upstream side secondary transfer outer roller 57*a*, it is desirable for the entrance angle θ to be set to a value not more than 40°.

Figure 7:
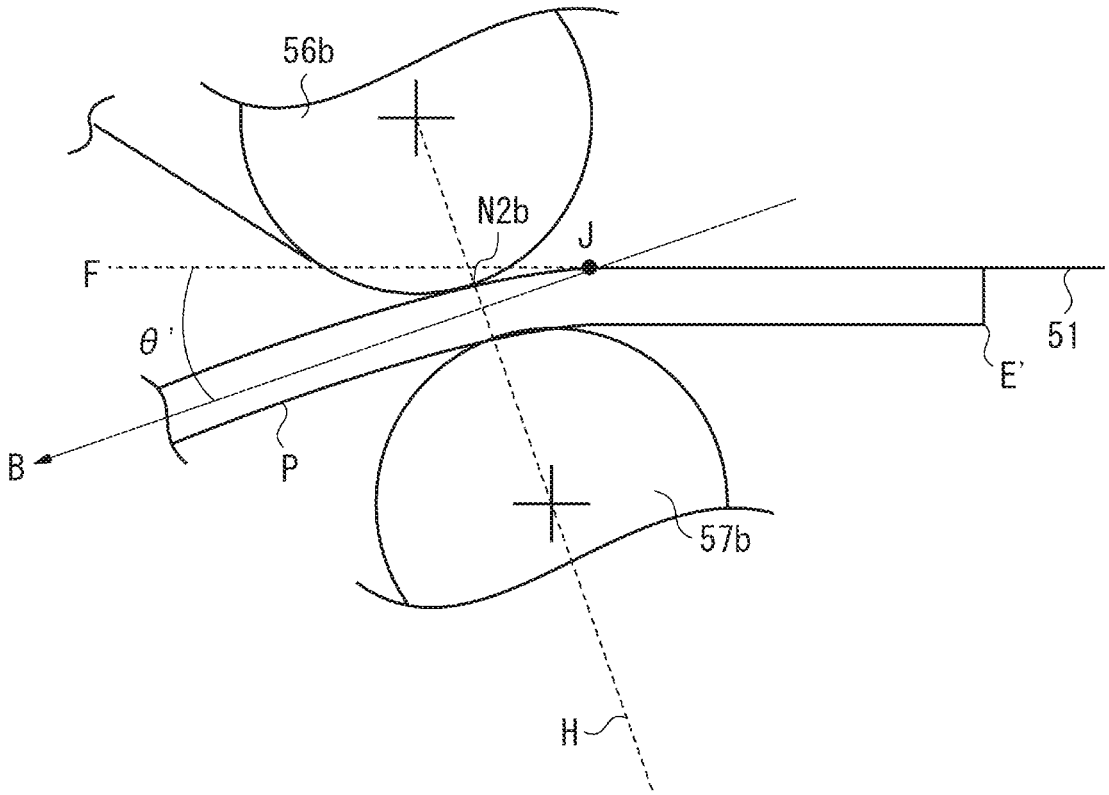
FIG. 7 is a diagram illustrating a portion around a downstream side transfer unit according to the first exemplary embodiment.

As illustrated in FIG. 7, in the present exemplary embodiment, when the downstream side transfer portion N2*b* pinches the recording material, the trailing side of the recording material is pressed against the outer surface of the linear portion of the intermediate transfer belt between the upstream side transfer portion N2*a* and the downstream side transfer portion N2*b*. Then, the traveling direction of the recording material is changed at the downstream side transfer portion N2*b*, and the recording material is placed in a bent state. In other words, of the plurality of transfer portions, at the downstream side transfer unit, the center of the secondary transfer outer roller is arranged on the upstream side of the center of the secondary transfer inner roller in the moving direction of the intermediate transfer belt. Then, the secondary transfer inner roller 56*b* is arranged so as to exhibit a portion situated on the same side as the intermediate transfer outer roller 57*b* with respect to the linear extension (F) of the intermediate transfer belt between the upstream side transfer portion N2*a* and the downstream side transfer portion N2*b*. In other words, the secondary transfer inner roller and the secondary transfer outer roller are arranged such that the secondary transfer inner roller 56*b* exhibits a portion S2 pushing the intermediate transfer belt to the arrangement side of the secondary transfer outer roller 57*b* beyond the extension of the intermediate transfer belt between the upstream side transfer portion N2*a* and the downstream side transfer portion N2*b*.

The reason for this arrangement will be illustrated with reference to FIGS. 6A and 6B.

In the case where the basic weight of the recording material P is not more than 256 g/m$^2$, the recording material itself is light. Thus, after the leading edge of the recording material has passed the downstream side transfer portion N2*b*, the trailing edge E' of the recording material P is conveyed to the downstream side transfer portion N2*b* with it adhesiveness with the intermediate transfer belt 51 being maintained (FIG. 6A). When, however, the basic weight of the recording material P is not less than 256 g/m$^2$ as in the case illustrated in FIG. 6B, the recording material is heavy. Thus, before the trailing edge E' of the recording material reaches the downstream side transfer portion N2*b* after passing the upstream side transfer portion N2*a*, the degree of adhesiveness between the upstream side trailing edge E' and the intermediate transfer belt 51 is reduced. As a result, when the recording material P is conveyed to the downstream side transfer portN2*b* with the trailing edge E' separated from the intermediate transfer belt 51, the trailing edge E' of the recording material flutters, and there is a fear of the image transferred by the upstream side transfer portion N2*a* being disturbed.

Accordingly, after the trailing edge of the recording material has passed the upstream side transfer portion N2*a*, it is desirable to maintain the adhesiveness between the trailing edge E' of the recording material and the intermediate transfer belt 51. In view of this, as illustrated in FIG. 7, in the present exemplary embodiment, when the downstream side transfer portion N2*b* pinches the recording material, the trailing side of the recording material is pressed against the outer surface of the linear portion of the intermediate transfer belt 51 between the upstream side transfer portion N2*a* and the downstream side transfer portion N2*b*. As a result, the reduction in the degree of adhesiveness between the trailing edge of the recording material and the intermediate transfer belt 51 is suppressed, thereby suppressing fluttering of the trailing edge E' of the recording material.

In FIG. 7, symbol B indicates the direction in which the downstream side transfer portion N2*b* sends out the recording material. Symbol H indicates the straight line connecting the rotation center of the downstream side secondary transfer inner roller 56*b* and the rotation center of the downstream side secondary transfer outer roller 57*b*. The direction in which the transfer unit sends out the recording material is orthogonal to the line connecting the rotation center of the secondary transfer inner roller and the rotation center of the secondary transfer outer roller, so that the line B is a normal (second normal) orthogonal to the line H.

In other words, in the present exemplary embodiment, when the downstream side transfer portion N2*b* pinches the recording material, the trailing side of the recording material is pressed against the outer surface of the linear portion of the intermediate transfer belt between the upstream side transfer portion N2*a* and the downstream side transfer portion N2*b*. In other words, the second normal B crosses the segment between the transfer portion N2*a* on the upstream side of the belt surface and the transfer portion N2*b* on the downstream side thereof at the intersection (second intersection) J. At the same time, on the upstream side of the second intersection J in the rotating direction of the intermediate transfer belt 51, the second normal B is situated on the inner peripheral surface side of the intermediate transfer belt 51. The secondary transfer inner rollers 56*a* and 56*b* and the secondary transfer outer rollers 57*a* and 57*b* are arranged so as to attain such a positional relationship. As a result, the reduction in the degree of intimacy between the trailing edge of the recording material and the intermediate transfer belt is suppressed, thus suppressing fluttering of the trailing edge E' of the recording material.

Figure 6A:
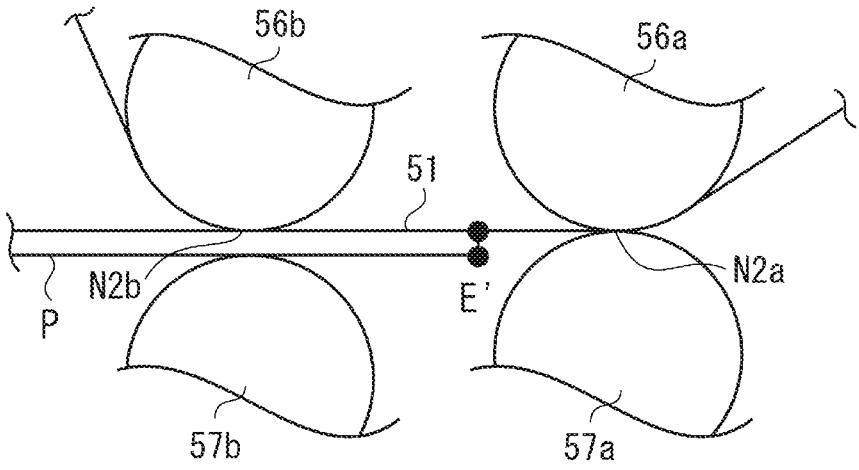
FIGS. 6A and 6B are diagrams illustrating a behavior of a trailing edge of the recording material.
Figure 6B:
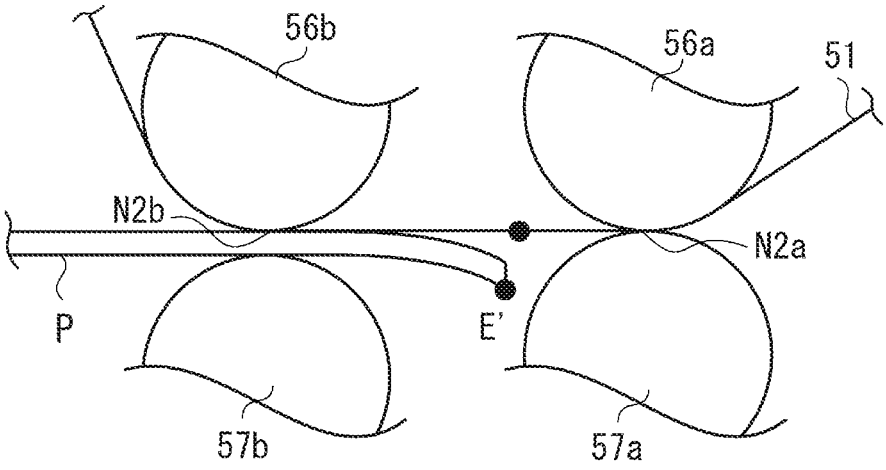

In FIGS. 6A and 6B, symbol θ' indicates the exit angle at which the recording material P pinched by the downstream side transfer portion N2*b* exists from the outer surface of the linear portion of the intermediate transfer belt 51 between the upstream side transfer portion N2*a* and the downstream side transfer portion N2*b*. In other words, the exit angle θ' (second angle) is an acute angle whose apex is at the second intersection J. Further, the exit angle θ' (second angle) is formed by the half-line of the second normal B on the downstream side of the second intersection J in the moving direction of the intermediate transfer belt 51 and by the half-line of the extension F on the downstream side of the second intersection J in the moving direction of the intermediate transfer belt 51. In the present exemplary embodiment, the exit angle θ' is set to 33°. Of course, this value is not to be construed restrictively. It is desirable for the exit angle θ' (second angle) to be set to be not less than 15° and not more than 40°. The reason for this setting will be illustrated.

When the exit angle θ' is small, the trailing edge of the recording material is not pressed against the intermediate transfer belt to a sufficient degree. Thus, it is impossible to attain to a sufficient degree the effect of maintaining the adhesiveness between the trailing edge of the recording material and the intermediate transfer belt. In view of this, it is desirable for the exit angle θ' to be set to 15° or more. On the other hand, when the exit angle θ' increases, the leading edge portion of the recording material is likely to be wrapped around the downstream side secondary transfer roller after leaving the downstream side transfer portion N2*b*. As a result, there is a fear of occurrence of defective conveyance. Further, defective conveyance may also occur when the leading edge of the recording material perpendicularly abuts the guide surface of the conveyance guide after the leading edge of the recording material has passed the downstream side transfer portion N2*b*. In view of this, to suppress defective conveyance of the leading edge of the recording material having left the downstream side transfer unit, it is desirable for the exit angle θ' to be set to be not less than 15° and not more than 40°. In the present exemplary embodiment, the entrance angle θ (first angle) is set to 15° and the exit angle θ' is set to 33° . In other words, the setting is made such that the portion of the intermediate transfer belt pushed by the upstream side secondary transfer inner roller 56*a* is smaller than the portion of the intermediate transfer belt pushed by the downstream side secondary transfer inner roller 56*b*.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-102670 filed May 2, 2011, which is hereby incorporated by reference herein in its entirety.

What is claimed is:

1. An image forming apparatus comprising:

an image bearing member configured to bear a toner image;

a movable intermediate transfer belt configured to bear the toner image transferred thereto from the image bearing member; and a transfer unit configured to transfer the toner image from the intermediate transfer belt to a recording material, wherein the transfer unit comprises:

a first transfer inner roller configured to support the intermediate transfer belt from an inner peripheral surface and configured to transfer the toner image to the recording material from the intermediate transfer belt;

a second transfer inner roller arranged on the downstream side of the first transfer inner roller in the moving direction of the intermediate transfer belt and configured to support the intermediate transfer belt from the inner peripheral surface and configured to transfer the toner image to the recording material from the intermediate transfer belt;

a first transfer outer roller arranged so as to be deviated downstream from the first transfer inner roller in the moving direction of the intermediate transfer belt and configured to form a first transfer portion by urging the first transfer inner roller from a side of an outer periphery of the intermediate transfer belt and to come into contact with the recording material and transfer the toner image to the recording material from the intermediate transfer belt; and a second transfer outer roller arranged so as to be deviated upstream from the second transfer inner roller in the moving direction of the intermediate transfer belt and configured to form a second transfer portion by urging the second transfer inner roller from the side of the outer periphery of the intermediate transfer belt and to come into contact with the recording material and transfer the toner image to the recording material from the intermediate transfer belt, wherein a first angle formed by an extension line of the intermediate transfer belt between the first transfer portion and the second transfer portion and a first line perpendicular to a straight line connecting a rotation center of the first transfer inner roller and a rotation center of the first transfer outer roller is smaller than a second angle formed by an extension line of the intermediate transfer belt between the first transfer portion and the second transfer portion and a second line perpendicular to a straight line connecting a rotation center of the second transfer inner roller and a rotation center of the second transfer outer roller.

2. The image forming apparatus according to claim 1, wherein the first angle is not less than 10° and not more than 40°.

3. The image forming apparatus according to claim 1, wherein the second angle is not less than 15° and not more than 40°.

* * * * *